US005586762A

United States Patent [19]

Wearley

[11] Patent Number: 5,586,762

[45] Date of Patent: Dec. 24, 1996

[54] METHOD OF PLAYING A QUADRILATERAL CHESS GAME

[76] Inventor: Jon P. Wearley, Box 248, Augusta, Mont. 59410

[21] Appl. No.: 345,804

[22] Filed: Nov. 17, 1994

Related U.S. Application Data

[62] Division of Ser. No. 178,380, Dec. 22, 1993, abandoned.

[51] Int. Cl.[6] ..... A63F 3/02

[52] U.S. Cl. ..... 273/261

[58] Field of Search ..... 273/260, 261

[56] References Cited

U.S. PATENT DOCUMENTS

| | | | |
|---|---|---|---|
| D. 55,455 | 6/1920 | Day . | |
| D. 129,154 | 8/1941 | Weller | 273/261 |
| D. 173,152 | 10/1954 | Gee . | |
| D. 241,358 | 9/1976 | Benson . | |
| 694,509 | 3/1902 | Winckfield | 273/261 |
| 701,414 | 6/1902 | Standidge . | |
| 1,134,922 | 4/1915 | Smith | 273/261 |
| 1,555,937 | 10/1925 | Billman | 273/261 |
| 3,730,527 | 5/1973 | Nelson | 273/261 X |
| 3,843,130 | 10/1974 | Whitney . | |
| 4,037,843 | 7/1977 | Hoffman . | |
| 4,136,880 | 1/1979 | Rikon . | |
| 4,147,360 | 4/1979 | Bailey . | |
| 4,696,478 | 9/1987 | Farrell | 273/261 |
| 4,708,349 | 11/1987 | Shomer . | |
| 4,778,187 | 10/1988 | Deak, Jr. . | |
| 4,856,789 | 8/1989 | Carlson | 273/261 |
| 4,932,669 | 6/1990 | Perry | 273/261 |
| 5,125,666 | 6/1992 | Adams | 273/261 |
| 5,280,913 | 1/1994 | Sirk | 273/261 |

FOREIGN PATENT DOCUMENTS

| | | | |
|---|---|---|---|
| 214636 | 5/1941 | Switzerland | 273/261 |
| 241021 | 2/1946 | Switzerland | 273/261 |
| 14484 | 1/1881 | U.S.S.R. | 273/261 |
| 1030519 | 5/1966 | United Kingdom | 273/261 |
| 2203660 | 10/1988 | United Kingdom | 273/261 |

*Primary Examiner*—William E. Stoll
*Attorney, Agent, or Firm*—Richard C. Litman

[57] ABSTRACT

An expanded game board provides for the play of chess or checkers by from two to four players or teams formed of such players, using the standard rules of chess or checkers as applicable. The chess board comprises a central matrix of eight ranks and eight files, thus providing the standard sixty four playing positions, and an additional extension of two ranks of eight files extending from each side. The four sets of chess pieces are designated according to different colors (e.g., white, black, emerald and maroon) and are placed upon the extensions to start the game. Play uses the standard rules of chess with no modifications required, as the corners of the board between adjacent extensions preclude diagonal passage of playing pieces thereacross. The board also includes designations of ranks providing for promotion of pieces, in order that pieces need not be advanced across the entire expanded board for promotion. For checkers, the board is expanded to provide three ranks in each of the extensions, for the placement of the standard four checkers in three rows or ranks. The rank designations for promotion provide for the conventional promotion of standard checkers to king status. Thus, the present board and modification provide for play of chess and checkers according to standard rules requiring no modification, by up to four players.

5 Claims, 4 Drawing Sheets

10
12
14
16
18
20
22
24
26
28
30
32
34
36
38
40
42
44
46
48
50
A B C D F G H I J K L M
12 11 10 9 8 7 6 5 4 3 2 1

METHOD OF PLAYING A QUADRILATERAL CHESS GAME

CROSS-REFERENCE TO RELATED APPLICATION

This application is a division of application Ser. No. 08/178,380 filed Dec. 22, 1993, abandoned.

FIELD OF THE INVENTION

The present invention relates generally to board games, and more specifically to a specialized chess and checker game board and method of play providing for simultaneous play by up to four players, playing either as individuals or as teams.

BACKGROUND OF THE INVENTION

For centuries, board games have remained a popular leisure time activity for people. As an example, the game of chess can be traced back to India, perhaps as far back as 2500 years. However, the standard game of chess (and checkers) is limited to play by only two persons at a time.

Nevertheless, the games of chess and checkers continue to hold their fascination for great numbers of people, and even when a casual game of chess or checkers is played, additional people will often gather to at least observe the game, if not interfere by making suggestions. In fact, at least one language has developed a word for such bystanders: Kibitzers.

Accordingly, the need arises for a chess game which can be played by up to four players at a time. Substantial use of the standard rules of chess is required insofar as possible, in order to allow experienced chess players to play without needing to learn numerous complex additional rules. The game board must provide the additional room required for play by four sets of chess pieces, while at the same time providing for promotion of pieces by advancing them in the usual manner. The apparatus must further provide for use as a checker board, e.g., by providing separate four player chess and checker boards on opposite sides of a playing board, with means providing for the promotion of checkers upon advancement to a designated place on the board, in the usual manner. Finally, the rules must allow for play by either individuals or as teams or partnerships.

DESCRIPTION OF THE PRIOR ART

U.S. Pat. No. 701,414 issued to Harry W. Standidge on Jun. 3, 1902 discloses a Game Apparatus comprising a checkered board having a central seven by seven square matrix with a three by seven square extension along each of the four sides. The board includes a tray at each corner, between each two adjacent extension ends. The three by seven square matrix of each extension provides for placement of only eleven diagonally spaced checkers thereon, rather than the twelve of standard play in a three by eight matrix twelfth checker is centrally placed in front of the other eleven for each side, with each side thereby having a perfectly symmetrical array for the starting position. The checkers are each numbered, with different numbers on each side, thus providing different relative values. Thus, neither the apparatus nor the method of play resemble the apparatus and method of the present game.

U.S. Pat. No. 3,843,130 issued to Karl R. Whitney, Jr. on Oct. 22, 1974 discloses a Chess Game For Two, Three Or Four Players comprising a standard central area of eight by eight squares, with each side having an extension of two by eight squares and each extension including an additional two squares extending outwardly and centrally therefrom, for a total of 136 squares. A standard set of chess pieces is placed upon each of the four extensions, with the additional two squares of each extension having two additional royalty pieces for each side. These royalty pieces maybe either knights, bishops, rooks/castles, or queens, as agreed upon. Moreover, it is noted that the placement of the king and queen do not follow standard chess rules, as each king is on the same file as the opposing queen. Thus, the Whitney, Jr. game departs significantly from standard chess.

U.S. Pat. No. 4,037,843 issued to Alfred J. Hoffman on Jul. 26, 1977 discloses a Board Game Apparatus having a six by six square central matrix with each side including a two by six square extension therealong. The game superficially resembles checkers, but substantial differences are provided, e.g., two pieces may occupy the same square, jumps are permitted along a file rather than being restricted to diagonals, and the number of squares and playing pieces are fewer than standard checkers. The present game provides a specialized game board permitting the game of checkers to be played by up to four players at a time, without otherwise substantially changing the method of play.

U.S. Pat. No. 4,136,880 issued to Eli Rikon on Jan. 30, 1979 discloses a Four Hand Checkerboard comprising a central area of seven by seven squares, with each side having an offset three by eight square extension therealong. The offset nature of the extensions allows the opposing pieces to be placed symmetrically along the same files of the board. However, the board itself is unsymmetrical due to the offset of the extensions, unlike the board and playing piece arrangement of the present game.

U.S. Pat. No. 4,147,360 issued to Kenneth M. Bailey (dec'd) on Apr. 3, 1979 discloses a Foursided Chess Game having a game board with a ten by ten central matrix, with each side having a four by ten extension. Two additional royal pieces and two additional pawns are provided, to fill two ranks with twenty pieces for each player. Other rules are extensively modified (e.g., castling, promotion of pawns and/or other pieces, pawn captures en passant, etc.) so the resulting game would require a great deal of effort to learn, even in the case of an experienced chess player. The present game places the pawn rows at the immediate edge of the central area, and no rule changes are required. Thus, a chess player of any level of experience can play the present game without need to learn different or additional rules.

U.S. Pat. No. 4,708,349 issued to Dan Shomer on Nov. 24, 1987 discloses Chess For Play By Two, Three Or Four Persons. The game board comprises a twelve by twelve central matrix with a two by eight square extension centered along each side. Although the moves of the various playing pieces are identical to standard chess, the larger central playing area changes the tactics of the game considerably. Promotion of pieces requires the complete crossing of the board by the piece, and then the piece may only be exchanged for a previously captured piece. These limitations are much more severe than standard chess. Shomer notes the disadvantages of other four player chess games, but the deeper board provided to alleviate opening move difficulties, adds further complications and differences, unlike the present game.

U.S. Pat. No. 4,778,187 issued to Joseph W. Deak, Jr. on Oct. 18, 1988 discloses a Modified Chess Game Method Of Play wherein the board resembles that of the Shomer patent above, but with a standard eight by eight central matrix rather than an unconventional larger array. However, the playing pieces must still start from extenstions which are four rows deep, as in Shomer. Deak, Jr. alters the standard rules of chess further by placing each king directly opposite the queen of the opposite side and on the same file, unlike standard chess. This is noted as providing needed symmetry, but standard chess rules have not been found to have any difficulty in this respect in their development over hundreds of years. The deeper extensions permit standard pawn opening moves, but then the moves are altered after pawn captures occur. The greater depth of the board including extensions also requires the pawns or other pieces to advance further before promotion, unlike standard chess or the present invention.

U.S. Pat. No. 4,932,669 issued to John T. Perry on Jun. 12, 1990 discloses a Method Of Playing A Multiple Player Chess Game. The game board is very similar to the Deak, Jr. board described above, but the extensions are only three rows deep rather than four. Pawns are permitted to change direction after a conventional diagonal capture move, thus the pawns must be provided with some indication as to their direction of travel in order to preclude improper subsequent captures or moves. Promotion of pawns or other pieces requires the crossing of the entire board, thus making such promotion considerably more difficult than in standard chess.

U.S. Pat. No. D-55,455 issued to Alfred Day on Jun. 15, 1920 discloses a Checker Board design substantially similar to the board configuration of the Perry patent discussed immediately above. No method of play is provided in the Day design patent.

U.S. Pat. No. D-173,152 issued to Yun Wing Lee on Oct. 5, 1954 discloses a Checkerboard having an appearance similar to the board of the Hoffman patent discussed above, but having extensions four rows deep along each side. Again, as this is a design patent, no function, game rules or method(s) of play are disclosed.

Finally, U.S. Pat. No. D-241,358 issued to John A. Benson, Jr. on Sep. 7, 1976 discloses a Chess Game Board having a configuration resembling the board of the Bailey patent discussed above. Again, no function, rules or method of play are disclosed in this design patent.

None of the above noted patents, taken either singly or in combination, are seen to disclose the specific arrangement of concepts disclosed by the present invention.

SUMMARY OF THE INVENTION

By the present invention, an improved board game is disclosed.

Accordingly, one of the objects of the present invention is to provide an improved board game which provides for play by from two to four players at a time, either individually or as teams or partners.

Another of the objects of the present invention is to provide an improved board game which utilizes most of the standard rules of chess with only slight variations to accommodate play by more than two persons.

Yet another of the objects of the present invention is to provide an improved board game which provides for playing checkers by more than two persons at a time, either as individuals or as teams or partners, without substantial non-standard rule changes.

Still another of the objects of the present invention is to provide an improved board game which includes a game board having provision thereon for play by up to four persons and which includes means providing for standard play of chess or checkers without substantial rule changes.

A further object of the present invention is to provide an improved board game in which the playing pieces are grouped into different colors with a specific color assigned to each player, thus providing distinction between pieces used by different players.

An additional object of the present invention is to provide an improved board game in which the winner of the game may be determined in the same manner as in standard chess or checkers, but which further allows for the determination of the winner and/or second and subsequent places according to the point values or quantity of the pieces remaining on the board.

A final object of the present invention is to provide an improved board game for the purposes described which is inexpensive, dependable, and fully effective in accomplishing its intended purpose.

With these and other objects in view which will more readily appear as the nature of the invention is better understood, the invention consists in the novel combination and arrangement; of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENTS

Figure 1:
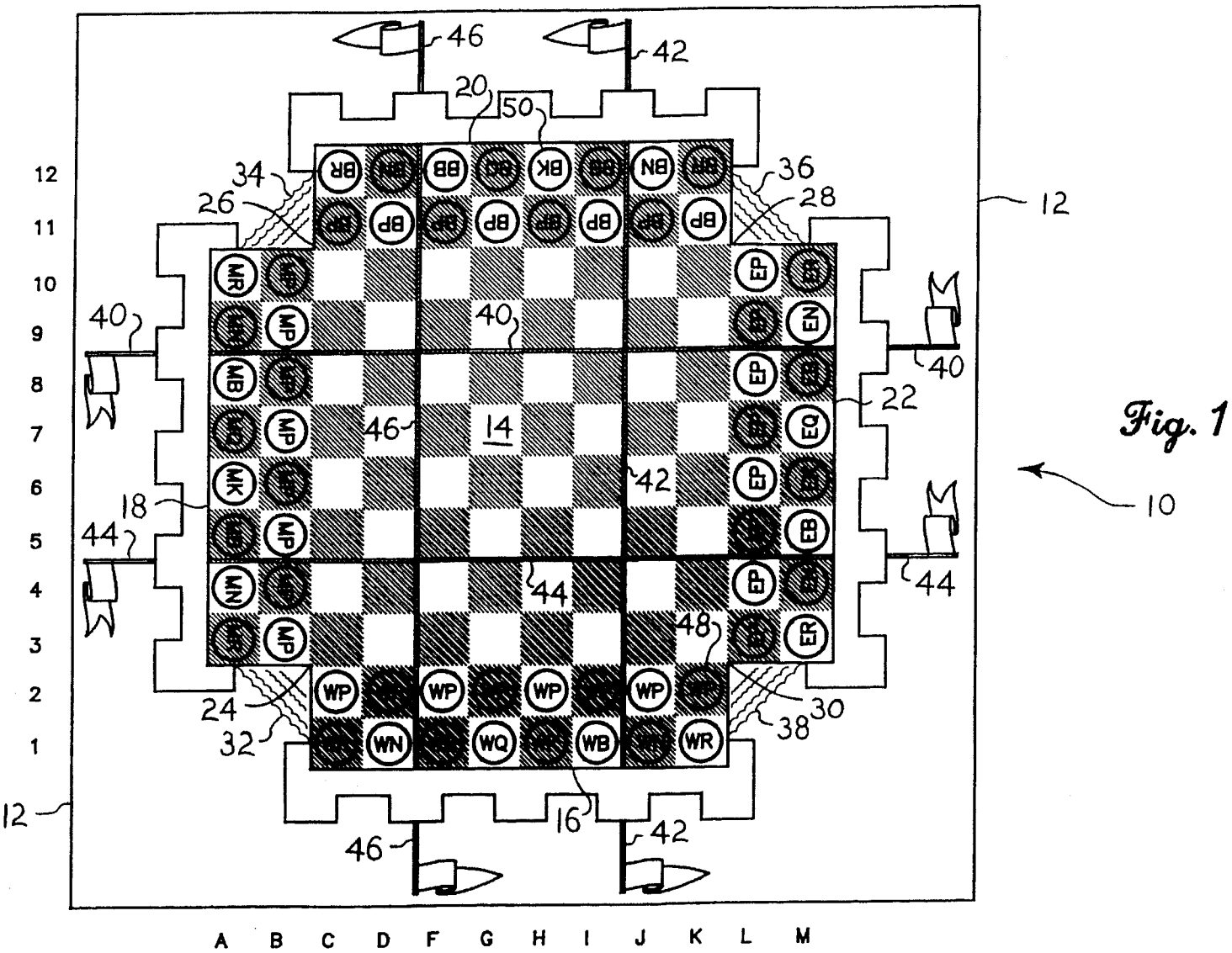
FIG. 1 is a plan view of the quadrilateral chess board of the present invention, showing its various features.

Referring now to the drawings, the present invention will be seen to relate to a quadrilateral chess and checker game which can be played by from two to four persons, either as individuals or as teams or partners. FIG. 1 discloses a quadrilateral chess game board 10 having a substantially square periphery 12. The chess board 10 includes a central matrix 14 of eight ranks and eight files of substantially square playing positions, thus providing a substantially square central area 14 with the ranks of the playing positions thereon designated by the numbers three through ten along the left edge of FIG. 1, and the files of the central matrix 14 designated by the letters C through K along the lower edge of FIG. 1. The board 10 further includes four extensions 16, 18, 20, and 22 extending from each side of the central matrix 14, each comprising two ranks and eight files and therefore comprising a total of sixteen playing positions each. The four extensions 16 through 22, in addition to the central matrix 14, thus comprise a total of 128 playings positions. The alphanumeric designations 1 through 12 and A through M respectively along the left edge and bottom edge of the board 10 thus may be used to describe any of the playing positions of either the central matrix 14 or any of the extensions 16 through 22, on the board 10.

The substantially square central playing area 14 will be seen to have four corners 24 through 30, with one of the corners between each adjacent extension. Thus, the first corner 24 lies between the adjacent ends of the first and second extensions 16 and 18, etc. In order to exclude play across diagonally adjacent playing positions at each corner (e.g., positions C-2 and B-3, etc.), "moats" or other designations 32 through 38 are located immediately outboard of each respective corner 24 through 30 and between the diagonally adjacent playing positions (e.g., K-2 and L-3, etc.). These areas 32 through 38 excluding play across the respective corners 24 through 30, preclude the immediate capture of an adjacent rook pawn (e.g., the pawn at C-11) by a rook pawn (e.g., the pawn at B-10) having an earlier move and using the standard pawn diagonal capture move of standard chess. This exclusion of diagonal moves across the corners 24 through 30 of the board 10, serves to allow for the use of standard chess moves and rules of play without additional modification to overcome any deficiencies of board layout for more than two players.

The standard rules of chess also provide for the promotion of pawns to a piece having a higher value, when the pawn is advanced to the opposite edge of the board without being captured. However, as the pawn rows of the present board 10 (ranks 2 and 11 and files B and L) are set back two rows from their standard positions on a standard eight by eight board, it will be seen that the pawns of the present game would have to advance a total of ten rows in order to reach the last row of the opposite extension. In standard chess, a pawn must advance only six rows to reach the opposite side of the board for promotion, or only some 60 percent of the distance across the present board 10. Accordingly, the present game includes promotion rank designators (lines, flags, etc.) 40 through 46, to indicate lines across the board 10 which are six rows removed from the pawn row of each extension. These promotion rank designators 40 through 46 maybe colored or otherwise marked to match the different sets or groups of playing pieces, as discussed below. Thus, any pawn from any of the pawn rows (ranks and files 2, 11, B, and L) need only be advanced six rows to the appropriate promotion rank designator (peripheral flag or other symbol, or line across the board) 40 through 46, rather than ten rows, in order to be promoted to a piece of higher value. The difficulty of pawn promotion is thus equal to that of standard chess, rather than being made more difficult due to a larger playing field.

Standard chess pieces, e.g., the white king rook pawn 48 and the black king 50, are used for the play of the present game. The second letter used on the playing pieces, e.g., "P" for each pawn of ranks and files 2, 11, B, and L, represent the ranks or values of the various playing pieces. Thus, the playing pieces 50 of playing positions C-1 through K-1, marked respectively as R, N, B, Q, K, B, N, and R, respectively represent the rook, knight, bishop and queen (queen side), and the king, bishop, knight and rook (king side), in standard chess positioning for the start of play. The first letter of each playing piece (W, M, B, and E) represent the designations of each separate group or set of pieces, respectively for each player of the game. Traditionally, the terms "black" and "white" are used for the two opposing sets or groups of chess pieces, although other relatively lighter and darker colors are well known (gray, beige, etc.). The present game requires four different colors in order to designate the four different sets of playing pieces 48 and 50, which colors are designated as white (W), maroon (M), black (B), and emerald (E). Other colors or means of designating the different sets of playing pieces may be used as desired.

The playing pieces 48 and 50 are arranged as shown in FIG. 1 for the start of play, with the white pieces arranged on the first extension 16 and the black pieces set up on the opposite third extension 20. It will be noted that both the black and the white pieces will be arranged so that a white playing position is located at the lower right corner of both the central matrix and their respective extensions 16 and 20, in traditional fashion. The queens of each set are placed upon playing positions having similar coloring or shading thereto (i. e., the white queen WQ is placed upon a lighter colored position and the black queen BQ is placed upon a darker position), so that they are on the same file (G, in this case). The relatively darker maroon pieces and relatively lighter emerald pieces are arranged accordingly, with their queens placed upon relatively darker and lighter positions and positioned on the same rank 7. Each of the opposed kings will also be seen to be positioned directly opposite one another, as in standard chess.

Play of the game is accomplished essentially as in standard chess, with the player assigned the white pieces positioned upon the first extension 16 having the first move. Play then proceeds clockwise, with the second player being to the left of the first player, and so on around the board. If desired, teams or partnerships may be formed between adjacent or opposed players about the board, or alternatively one relatively advanced player may play against two or more less experienced players. The present game provides for flexibility in the formation of opposing sides, and the strategy and tactics resulting from such.

Figure 3:
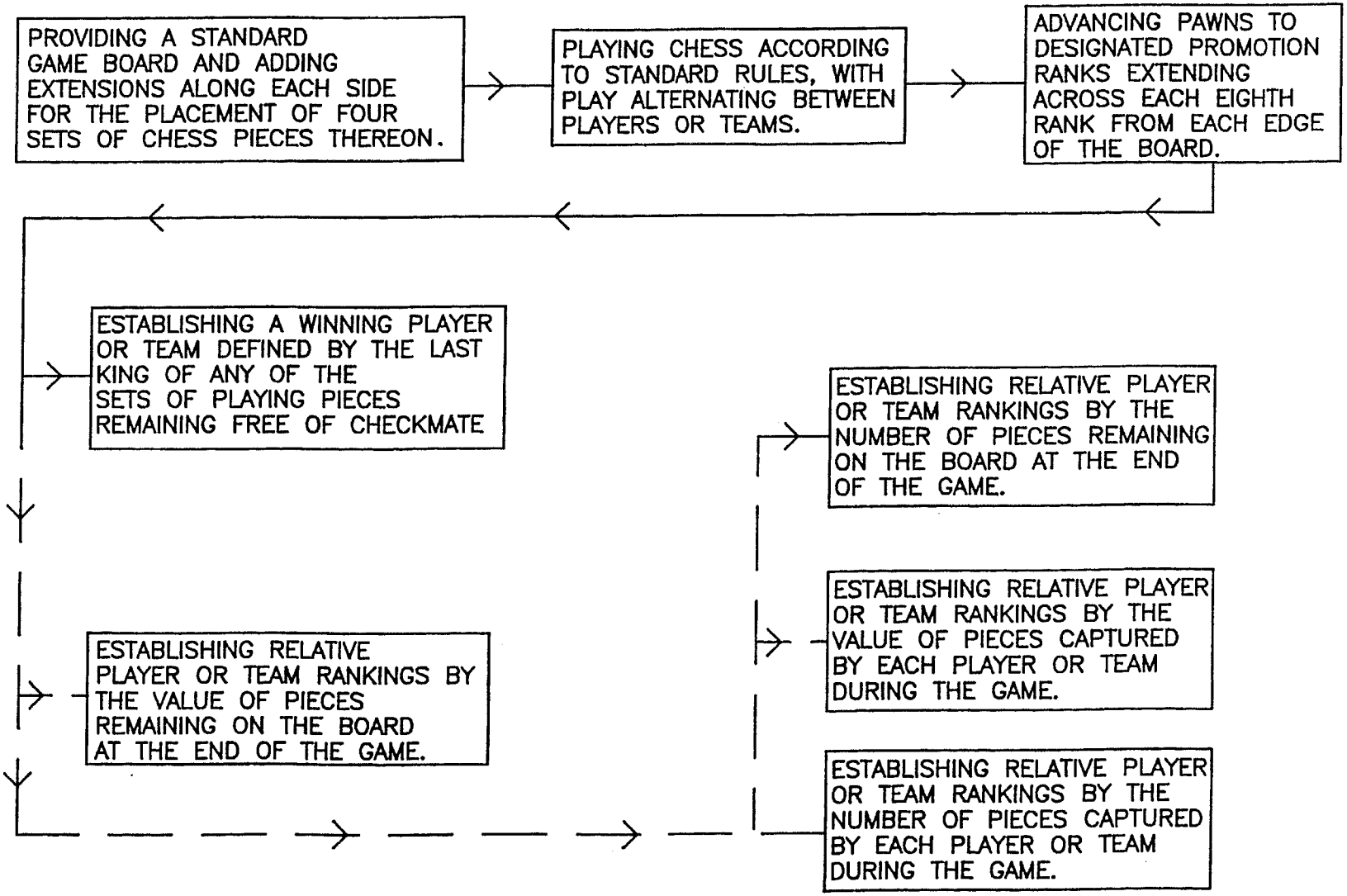
FIG. 3 is a block diagram of the method of play of the quadrilateral chess game of the present invention.

Any standard chess moves may be made as desired, with the only exception being the prohibition of a diagonal capture move by a rook pawn from its starting position due to the "moats" or play exclusion areas 32 through 38 respectively at each corner 24 through 30 of the central matrix 14. However, once a rook pawn advances past the respective corner, diagonal capture is permitted according to the standard rules of chess. The same prohibition against "cutting the corners" applies also to all other pieces 48 and 50 on the board 10. Pawns may be promoted in accordance with the standard rules of chess as discussed above, by advancing to the appropriate promotion rank designator, six rows advanced from each pawn starting row. FIG. 3 provides a block diagram of the play of the present game.

Play is continued according to the standard rules of chess, until only a single king remains free of checkmate, thus defining a winner of the game. However, rather than removing the playing pieces of the players whose kings have been checkmated, the pieces remain on the board wherever they were located at the time of checkmate; they are "locked" in those positions for the remainder of play unless captured, with the checkmated player no longer allowed to move in turn. The playing pieces of the checkmated king are thus obstacles on the board, rather than having any further offensive power whatsoever. They may be used by the remaining players to maneuver around to block an attack line, or to captured, etc., as the game is played out. As the checkmated king no longer has any power, the other kings in play are allowed to move to positions adjacent the checkmated king, as no capture may be made by either the kings in play of the checkmated king, or by the checkmated king of the kings in play.

Chess convention provides for relative values of the playing pieces, in order for players to determine whether a given exchange is worthwhile. Pawns are arbitrarily given a value of one, with knights and bishops each having a value of three pawns, rooks a value of five pawns, and queens a value of nine pawns. This convention of relative values may also be used to determine the relative ranking of the players or teams of the present game. The winning player or team of the game may be determined as in conventional chess, by having the last king remaining free of checkmate. However, second, third and fourth places may be determined by the total values of each player's or team's pieces remaining on the board at the time their king(s) was checkmated, or alternatively the total values of each player's or team's pieces which were captured by other players or teams during play. In the standard two player game, only a winner and a loser can be determined. As the present game provides for up to two intermediate positions, the use of the values of the pieces remaining on the board or captured may be used to determine the relative placement of the second through fourth place players. Alternatively, the absolute number(s) of pieces remaining on the board 10 or captured at the end of the game may be used, desired.

Figure 2:
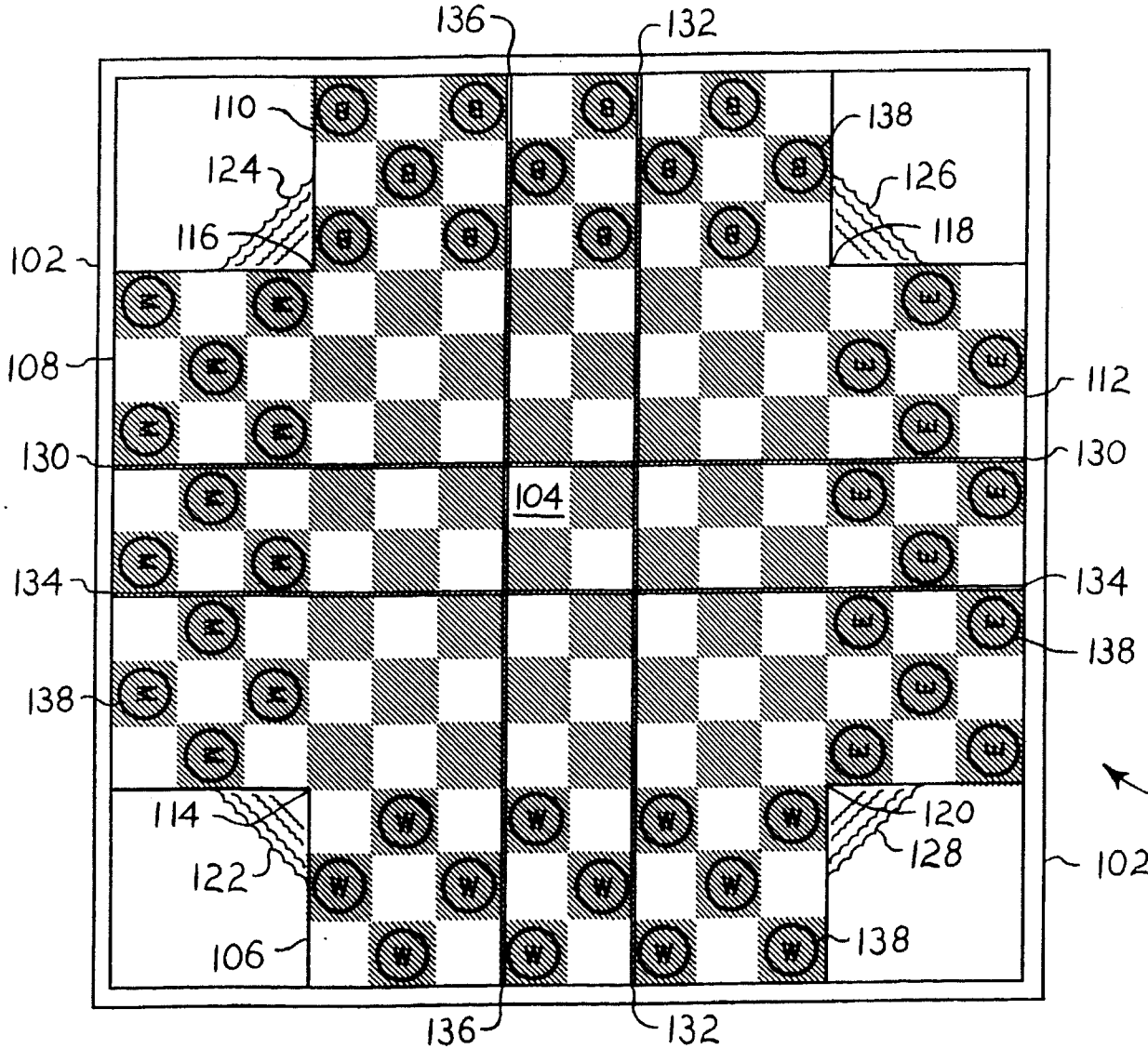
FIG. 2 is a plan view of the quadrilateral checker board of the present invention, and its similarities to the chess board of FIG. 1.

A similar game board may be used for playing checkers and providing for play by up to four players, either playing as individuals or as teams or partnerships. FIG. 2 discloses a quadrilateral checker game board 100 having a substantially square board periphery 102 and including a central matrix 104 comprising eight ranks and eight files of playing positions for a total of 64 playing positions, as in the standard checkerboard. The game board 100 also includes four extension is 106 through 112, in the manner of the quadrilateral chess game board 10 of FIG. 1. However, each of the extensions 106 through 112 will be seen to comprise three rows of eight positions each, or a total of 24 playing positions for each extension. This is due to the fact that the game of checkers utilizes only the diagonally identically colored or marked positions on a board, thus requiring three rows of four positions in each row for the starting placement of the required twelve checkers for each player. The four extensions with their 24 positions each, along with the 64 positions of the eight by eight central matrix, result in a total of 160 playing positions on the quadrilateral checkerboard 100 of FIG. 2. (However, only 80 of those playing positions would be used during a game, due to the requirement that the checkers remain only on one color of the board positions.)

The substantially square central matrix 104 of the board 100 includes four corners 114 through 120, in the manner of the corners 24 through 30 of the quadrilateral chess board 10 of FIG. 1. Each of these corners 114 through 120 is positioned between two adjacent extensions, in the manner of the corners 24 through 30 and extensions 16 through 22 of the board 10 of FIG. 1. "Moats" or play exclusion areas 122 through 128 are positioned diagonally outward from each of the corner is 114 through 120 to preclude play thereacross, in the manner of play exclusion areas 32 through 38 of the board 10. Thus, a checker positioned at the extreme corner of any of the extensions 106 through 112, and adjacent the edge of the central matrix 104, is prohibited from diagonally crossing that corner directly to the adjacent extension. These play exclusion areas serve to allow the use of standard rules of play for the game of checkers, without any rearrangement of playing pieces or other alteration of rules.

The standard rules of checkers also provide for the promotion ("kinging" or "crowning") of checker pieces when they are advanced across the board to the opposite side or edge. As the standard games of chess and checkers both use an eight by eight playing board, and each set or group of checkers takes up the opposite first three rows along each side of such a board, it will be seen that a checker starting from the front row need only be advanced five rows or ranks in order to reach the opposite side or edge of the board. The additional three ranks of the extensions 106 through 112 result in a board 100 having a total of fourteen ranks from one side to the other. This would result in extreme difficulty in reaching the opposite side of the board in order to promote or "crown" a checker, thus significantly altering the strategy of the game. Accordingly, promotion rank designators or lines 130 through 136 are provided in order to require a front row checker to advance only five ranks, as in standard checkers play. These designators 130 through 136 may take the form of lines extending across the board 100 or any other suitable symbol, and are marked on or across the board 100, five rows or ranks from the starting row of checkers in each of the extensions. In other words, the promotion rank designator 130, designating the rank which must be reached by checkers starting from the first extension 106, is placed across the board 100, five rows or ranks removed from the first row of the extension 106 and the checkers starting thereon. Promotion rank designator 132 serves to designate the promotion rank for the checkers starting from the second extension 108, and so forth. Once a checker has advanced to the appropriate rank as designated by the appropriate promotion rank designator, that checker is "crowned" or promoted and is free to reverse its movement and is permitted to move to any eligible position on the board, in accordance with the standard rules of play for checkers.

Four sets or groups of checker playing pieces 138 are used in the play of the present game. These checkers 138 may be standard checkers, with the different sets or groups provided for each player being marked or distinguished in some way from one another, e.g., by different colors, Standard checkers are generally provided in red and black, which colors may be used for two of the sets used in the present game, if desired. However, for uniformity, the color designations of the checkers 138 shown in FIG. 2 are designated the same as the differently colored chess pieces 48 and 50 discussed above, i.e., white, black, maroon, and emerald, designated as W, B, M, and E, respectively on the first extension 106, third extension 110, second extension 108, and fourth extension 112. As noted above, other colors or markings may be used if desired.

The game is readied for play by placing the four sets or groups of playing pieces 138 on the diagonally matching positions of the four extensions 106 through 112. Play is begun by a first player (e.g., the player using the W or white checkers) making a first move, with play continuing around the board 100 in a clockwise direction. If desired, teams or partnerships may be formed between adjacent or opposed players about the board, or alternatively one relatively advanced player may play against two or more less experienced players, as noted in the discussion of the quadrilateral chess game above.

Due to the requirement for the pieces 138 to remain on diagonally matching positions, it will be seen that two diagonally opposite corners 116 and 120 of the board 100 have diagonally adjacent positions with adjacent checkers 138 of different sets or groups thereon. However, the "moats" or play exclusion areas 124 and 128 immediately outside of these corners 116 and 120, preclude play directly across the diagonal positions immediately adjacent one another. Thus, play may be made according to standard rules of play of checkers, with no modifications needed to allow for play by more than two players.

Figure 4:
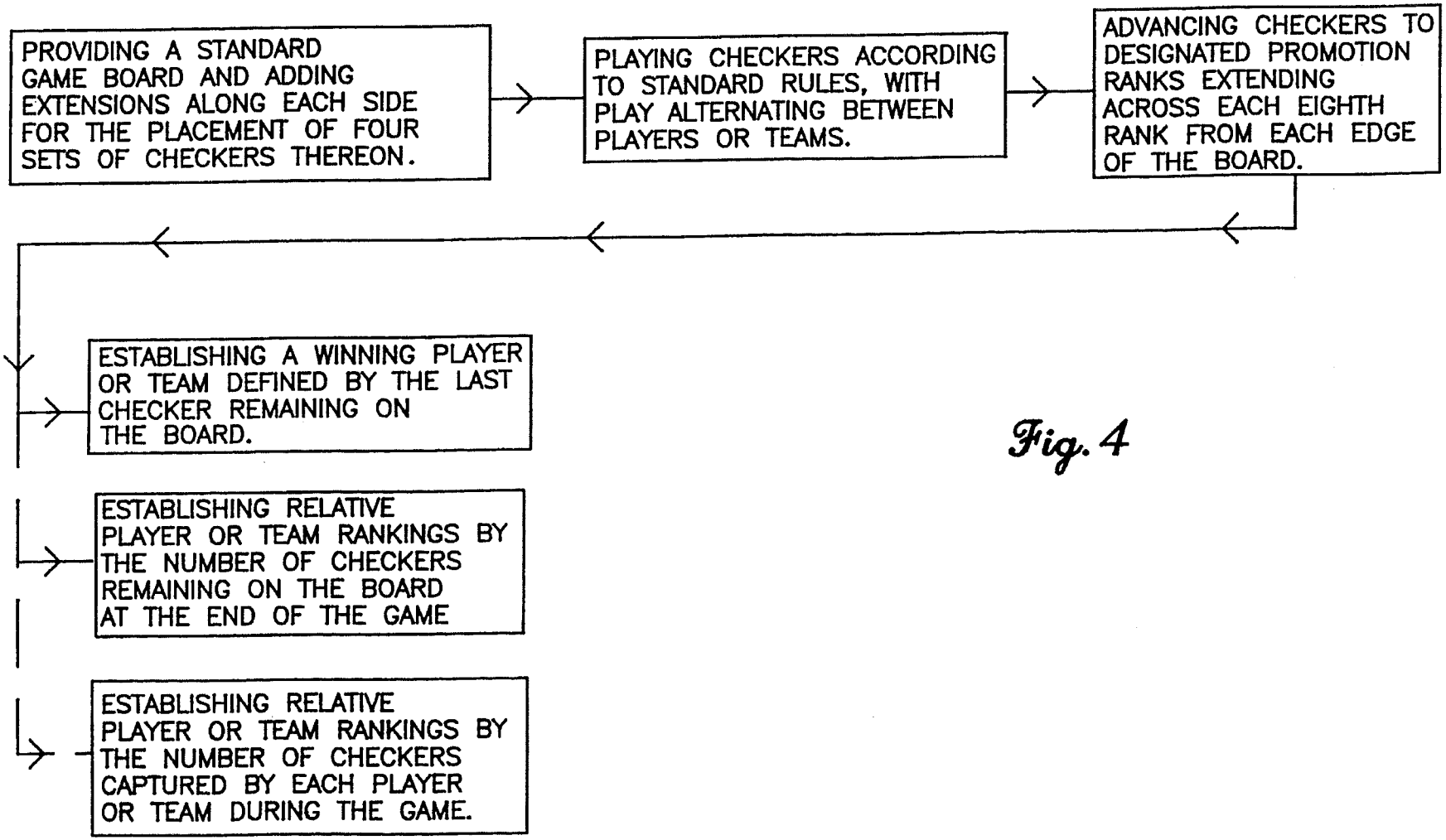
FIG. 4 is a block diagram of the method of play of the quadrilateral checker game of the present invention.

Play continues with each player or team advancing his respective checkers 138 forward and diagonally to the left or right, and capturing pieces 138 of the sets of other players or teams by jumping those pieces, in accordance with standard rules. When a player's checker 138 has advanced to the appropriate promotion rank as marked by the appropriate promotion rank designator, that piece 138 is "crowned" or otherwise designated to have the capability of diagonal moves in any direction, in accordance with standard checker rules. The winning player or team of the game is the player or team having the last checker 138 remaining on the board. The present game also permits the determination of relative rankings of the second through fourth players, by the relative number of opponents' playing pieces 138 which they have captured (or alternatively, which remain on the board) during the course of the game. FIG. 4 provides a flow chart describing the method of play of the present game, including the means of determining the relative rankings of the second through fourth players.

In accordance with the above disclosure, the present invention provides for the play of chess or checkers by up to four persons, with no modifications to the standard rules of play. The game boards 10 and 100 include extensions for the starting positions of the playing pieces, and the play exclusion areas limit moves from one extension corner to an immediately adjacent opponent's extension corner, in keeping with the impossibility of such moves in a standard two player game. The promotion rank designators provided across the playing fields or at the edges of the extensions of the boards, provide for the promotion of the playing pieces after advancement of those pieces a number of ranks equal to that required in the play of standard chess or checkers for such promotion. Thus, the strategy for advancement and promotion of pieces for the present quadrilateral chess and checker games remains the same as for the conventional two player games, as no additional difficulty is required to advance pieces a greater distance across the board. The two boards 10 and 100 will be seen to be closely related, and may be included on opposite sides of a single sheet of material, if desired. Other modifications are possible, such as adding an additional rank to each of the extensions of the quadrilateral chess board 10, in order to provide a quadrilateral checkerboard 100 as shown in FIG. 2. While reference has been made generally to play by individuals, it will be noted that each of the above games lends itself well to team play, as discussed at various points above.

It is to be understood that the present invention is not limited to the sole embodiments described above, but encompasses any and all embodiments within the scope of the following claims.

I claim:

1. A method of playing a chess-like board game providing for simultaneous play by from two to four players or plural teams formed thereof, the method comprising the following steps:

providing first, second, third and fourth groups of chess pieces, with each of said groups of chess pieces including means distinguishing said chess pieces of said each of said groups from said chess pieces of other said groups;

further providing a game board having a central matrix of sixty-four playing positions comprising eight ranks and eight files in a substantially square array, and four sides with each of said sides including an extension having two ranks and eight files of sixteen playing positions extending therefrom, thereby providing a total of twelve ranks across said board in each of four directions starting from each said extension, said central matrix including four corners each having means excluding play thereacross extending between each adjacent said extensions of playing positions, said game board further including means thereon designating and distinguishing from all other ranks of playing positions at an eight rank across said game board in each direction starting from each said extension;

alternatingly moving one of said chess pieces from each of said groups in turn according to the rules of chess;

attempting to advance pawns of each of said groups to reach said rank designation mean at said eighth rank, thereby promoting said pawns to chess pieces of higher value in accordance with the standard rules of chess;

attempting to reach a checkmate position against each of the kings of each of said group of chess pieces; and continuing in the above manner until a king of only one of said groups of chess piece remains free of checkmate, thereby establishing a winner of said game.

2. The method of claim 1 including:

providing a relative value for each of said chess pieces according to conventionally assigned relative values used in the game of chess, and;

establishing a relative ranking of players at the end of said game according to the total value of said chess pieces remaining on said game board, with the highest ranking player having pieces of the greatest total value remaining on said board.

3. The method of claim 1 including:

providing a relative value for each of said chess pieces according to conventionally assigned relative values used in the game of chess, and;

establishing a relative ranking of players at the end of said game according to the total value of said chess pieces captured by each player, with the highest ranking player having captured pieces having the greatest total value.

4. The method of claim 1 including:

establishing a relative ranking of players at the end of said game according to the number of said chess pieces remaining on said game board, with the highest ranking player having the greatest number of said chess pieces remaining on said board.

5. The method of claim 1 including:

establishing a relative ranking of players at the end of said game according to the number of said chess pieces captured by each player, with the highest ranking player having the greatest number of captured said chess pieces.

* * * * *